US006330816B1

(12) United States Patent
O'Connor

(10) Patent No.: US 6,330,816 B1
(45) Date of Patent: Dec. 18, 2001

(54) LOCK BOX MOUNTING BRACKET

(75) Inventor: David C. O'Connor, Falls Church, VA (US)

(73) Assignee: SOCO, Inc., Falls Church, VA (US)

( * ) Notice: Subject to any disclaimer, the term of this patent is extended or adjusted under 35 U.S.C. 154(b) by 0 days.

(21) Appl. No.: 09/475,253

(22) Filed: Dec. 30, 1999

Related U.S. Application Data

(63) Continuation-in-part of application No. 09/237,858, filed on Jan. 27, 1999, now abandoned.

(51) Int. Cl.[7] ..... E05G 1/00

(52) U.S. Cl. ..... 70/63; 70/2; 109/50; 232/22; 248/214; 248/552

(58) Field of Search ..... 70/2, 54–56, 58, 70/63; 248/552, 214, 231.51, 300; 109/50–52; 232/1 C, 22, 42

(56) References Cited

U.S. PATENT DOCUMENTS

| | | | | |
|---|---|---|---|---|
| 485,613 | * | 11/1892 | Deavle | 16/82 X |
| 2,023,826 | | 12/1935 | Van Buskirk | 232/42 |
| 2,273,580 | | 2/1942 | Kruschwitz et al. | 232/1 |
| 2,539,935 | | 1/1951 | Stephens et al. | 248/226 |
| 3,436,937 | | 4/1969 | Barrett | 70/63 |
| 3,712,091 | * | 1/1973 | Pavent | 70/63 |
| 3,742,741 | * | 7/1973 | Cahan | 70/63 |
| 3,744,281 | * | 7/1973 | Logue et al. | 70/58 |
| 3,934,434 | | 1/1976 | Law | 70/63 |
| 4,112,717 | * | 9/1978 | Bradley | 70/63 |
| 4,463,584 | * | 8/1984 | De Forrest | 70/63 |
| 4,494,690 | | 1/1985 | Dupuis | 232/22 |
| 4,532,783 | | 8/1985 | Maurice | 70/63 |
| 4,535,612 | * | 8/1985 | Seremet | 70/56 |
| 4,609,780 | | 9/1986 | Clark | 179/2 A |
| 4,641,505 | | 2/1987 | Maurice | 70/63 |
| 4,694,668 | | 9/1987 | Ciletti et al. | 70/63 |
| 4,703,850 | * | 11/1987 | Walker | 206/293 |
| 4,746,062 | | 5/1988 | Bartylla | 232/1 C |
| 4,854,016 | * | 8/1989 | Rice | 24/495 |
| 5,046,339 | * | 9/1991 | Koell | 70/55 |
| 5,084,945 | | 2/1992 | Childers | 24/530 |
| 5,218,846 | | 6/1993 | Cook et al. | 70/56 |
| 5,563,579 | * | 10/1996 | Carter | 70/63 X |
| 5,590,608 | | 1/1997 | Yore et al. | 109/50 |
| 5,624,071 | * | 4/1997 | Sosan | 70/63 X |
| 5,775,149 | * | 7/1998 | Small | 70/63 X |

* cited by examiner

*Primary Examiner*—Lloyd A. Gall
(74) *Attorney, Agent, or Firm*—Nixon Peabody LLP; Tim L. Brackett, Jr.

(57) ABSTRACT

A lock box mounting bracket is provided for securely locking a lock box to a door and hinge which includes a one-piece bracket body having interior and exterior portions, and a bracket locking device mounted on the interior portion of the bracket body. The bracket locking device is mounted so as to be positioned in the interior space on the secured side of the door thereby preventing removal of the mounting bracket when the door is in the closed position. In addition, when the door is in the open position, the bracket locking device impedes the ability of unauthorized personnel from easily removing the lock box mounting bracket from the door and hinge. The bracket locking device includes connector portions formed on an upper section of the interior portion and a lower section of the interior portion for engagement by a connecting element. The lock box protection device includes a side wall extending outwardly from the exterior portion to protect the lock box and its shackle from side access. The lock box protection device may also include a shield positioned in front of a lock box engaging element attached to the exterior portion so as to block frontal access to the lock box shackle. In addition, lock box protection device may include one or more transverse projections extending transversely across the front of the exterior portion outwardly from the shield to further hinder access to the lock box and shackle.

39 Claims, 9 Drawing Sheets

LOCK BOX MOUNTING BRACKET

This is a continuation-in-part application of Ser. No. 09/237,858, filed Jan. 27, 1999 now abandoned.

TECHNICAL FIELD

This invention generally relates to a removable mounting bracket for securing a lock box, containing an access device, to a door. More specifically, this invention relates to a high security mounting bracket that protects a lock box from tampering and removal.

BACKGROUND OF THE INVENTION

Lock boxes enable limited access to premises so that authorized persons, such as repairmen, servicemen, or realtors, may enter the premises to perform their service when the occupant of the premises is not present. Lock boxes are extensively used in the real estate industry in connection with the showing of real estate property to prospective purchasers. It is impractical and undesirable to provide each real estate agent with a key to the listed property. In addition, requiring an agent to obtain a key from the real estate sales office prior to showing each property is somewhat inconvenient. Lock boxes provide a solution to these problems.

A lock box generally includes a hollow box in which the key for a listed property may be placed. Lock boxes are typically provided by a realtor entrusted with the sale of the property. The realtor secures the lock box to the property so that a key to the home is always on the premises in a locked, safe place. The local real estate board may then issue keys to the lock box to board-participating realtor. Agents, having a lock box key, arrive at a home, open the lock box to access the homeowner's key, and then use the homeowner's key to open the door and show the home.

Lock boxes have been designed to mount to the doorknob of an access door to the home. This type of lock box generally comprises a hollow key receptacle mounted by a shackle to the shaft section of an exterior doorknob, or in some cases, a gate, fence or other secure mounting location that will accept a locking shackle. Examples of such lock box assemblies are those disclosed in U.S. Pat. Nos. 3,436,937; 4,532,783; 4,609,780; and 4,641,505. However, these doorknob-mounted lock box assemblies often cause structural damage to the door. As the door is closed, the centrifugal force of the closing door may swing the lock box into the door, marring the doorknob and denting or otherwise damaging the door and door jamb.

In order to try to minimize the possible damage to doorknob-mounted lock boxes, shielding structures and stabilizing brackets for such lock boxes have been devised, for example, as shown in U.S. Pat. Nos. 5,218,846 and 5,084,945, respectively. Nevertheless, doorknob-mounted lock boxes frequently interfere with operation of the doorknob, causing the homeowner inconvenience.

Another type of lock box assembly is disclosed in U.S. Pat. No. 3,934,434. This lock box includes a bracket which can be mounted on the top of a door. Mounting the lock box over the top of the door, however, places the lock box above a convenient height for an average-sized person to reach. In addition, lock boxes and other box structures are known which have been mounted on a door edge, either the knob edge or the hinge-edge between the door and door jamb. Examples of such structures are the devices shown in U.S. Pat. Nos. 2,023,826; 2,273,580; 4,494,690; 4,694,668; and 4,746,062.

While these prior art structures have provided many advantages, the doorknob-mounted structures have interfered with door operation and/or marred the door. The doortop brackets are awkward or impossible for short people to use, and the door edge bracket structures have had a common problem. Once the door is opened, they can be removed and thrown away.

One of the biggest security problems in connection with the use of lock boxes is the real estate agents themselves. Agents can present the biggest exposures to burglaries. Once the door is opened, the agent-burglar simply destroys or disposes of the lock box assembly and/or its memory. In addition, conventional mounting assemblies provide easy access to the lock box shackle and/or the portion of the mounting assembly to which the lock box is attached. As a result, tools such as bolt cutters, can be used to break the security of the connection. Once removal of the lock box is achieved, the box can be taken to another location providing greater opportunity for forced entry into the key-containment chamber of the box.

U.S. Pat. No. 5,590,608 discloses a lock box mounting assembly for mounting on the door edge adjacent the door hinge. This device includes a bracket which wraps around the edge of the door and an eye element extending from the exterior plate for receiving the lock box shackle. In one embodiment, the bracket structure is mounted on the door by positioning the bracket in the reveal space when the door is in the open position and sliding the structure along the edge of the door to a resting position against the hinge. In a second embodiment, the bracket is securely attached to the door by positioning the bracket between the door and the hinge portion normally directly attached to the door. The hinge screws are then inserted through the hinge and the bracket, and into the door. In yet a third embodiment, the bracket includes two separate plates removably positioned on opposite sides of the hinge. Each plate includes a flange containing an opening for alignment with the opening in the other plate flange. The lock box shackle extends through the flanges to connect the lock box to the assembly while also functioning to secure the plates to each other and, importantly, to the door. However, undesirably, in the first embodiment, once the door is opened, the bracket mounting assembly can be easily removed. In addition, in the second embodiment, the door hinge screws must be removed and replaced each time the mounting assembly is installed or removed thereby disadvantageously adding an unnecessary amount of time and effort to the installation process. In the third embodiment, removal of the lock box will necessarily result in the separation of the plates creating a cumbersome disassembly process. All of these embodiments also result in the shackle being vulnerable to cutting by bolt cutters, hacksaws and related burglary tools, etc. Another related drawback of this assembly is the easy access to the portion of the assembly to which the shackle is attached. These portions, i.e. flange or eye element, are equally easily accessible for cutting by tools thereby allowing removal of the device with the shackle still locked in place.

Consequently, there is a need for a lock box mounting assembly which securely attaches to a door while effectively impeding unauthorized removal of the mounting assembly and/or lock box.

SUMMARY OF THE INVENTION

In view of the foregoing, it is an object of the present invention to provide a lock box security mounting bracket capable of overcoming the deficiencies of the prior art and effectively minimizes the likelihood of access to a key stored in a lock box mounted on a door.

It is also an object of the present invention to provide a mounting bracket which will not damage doors, is easy to use and yet is securely locked to the door so as to provide enhanced security.

It is another object of the present invention to provide a lock box mounting bracket which is easily mounted and locked on a homeowner's door in a clearly visible place, and yet will not interfere with door operation.

It is another object of the invention to provide a lockable lock box mounting bracket which securely mounts a lock box to a homeowner's door and will not mar or dent the door, doorknob, door jamb, or cause other structural damage as the door is opened and shut.

Another object of the present invention is to provide a lock box mounting bracket which is minimizes the cost and time necessary to mount the bracket.

A further object of the present invention is to provide a lock box mounting bracket which provides optimum protection of the lock box, and specifically the lock box shackle, from damage by tools.

Yet another object of the present invention is to minimize the ability to remove the lock box and/or mounting assembly from the door without proper authorization and access approval.

Still another object of the present invention is to provide a lock box mounting bracket which only permits removal of the bracket from a door by accessing a locking mechanism on the interior space of the dwelling.

A still further object of the present invention is to provide a standardized method of attaching key access devices to doors which offers maximum protection equally in all installations by eliminating the vulnerable variations of existing shackle mounting options such as door knobs, fences, knockers etc.

Yet another object of the present invention is to provide a high-security mounting bracket to which attachments can be secured, such as access-control devices or depository structures.

It is another object of the present invention to provide a high-security mounting bracket that protects the shackle used on conventional lock boxes from cutting or forcible blows, and subsequent removal.

Yet another object of the present invention is to provide a high-security mounting bracket that protects the body portion of the currently used shackle-mount type lock boxes from forcible blows, preventing physical and electronic damage to the lock box device, and reducing accessibility to the key storage area by chisels, drills, and other common burglary tools.

These and other objects of the present invention are achieved by providing a lock box security mounting bracket for mounting on a hinge-edge of a door mounted on a hinge and movable between open and closed positions. The door includes an interior side facing an interior space and an exterior side facing an exterior space when the door is in the closed position. The lock box mounting bracket comprises a bracket body shaped for mounting on the hinge-edge of the door including an exterior portion for supporting a lock box. The exterior portion is positioned in the exterior space when the lock box mounting bracket is mounted on the door. The lock box mounting bracket also includes a bracket locking device formed on the bracket body and positioned in the interior space when the bracket body is mounted on the door for permitting secure locking of the bracket body to the door hinge and preventing unauthorized removal of the lock box mounting bracket when the door is in both the open and closed positions. The bracket body may further include an interior portion positioned in the interior space when the lock box mounting bracket is mounted on the door. The interior portion includes a lower leg extending into the interior space on a lower side of the hinge and an upper leg extending into the interior space on an upper side of the hinge. The bracket locking device is formed on the interior portion of the bracket body. The bracket locking device may include a first connector portion formed on the lower leg, a second connector portion formed on the upper leg and a connector element extending between, and connecting, the first and the second connector portions. The first and the second connector portions may each include an opening formed in the lower leg and the upper leg, respectively for receiving the connector element. The bracket locking device may include at least one locking arm pivotally mounted on at least one of the upper and the lower legs. The bracket locking device may further include a connector portion formed on one of the upper and the lower legs for engagement by the locking arm. Alternatively, the at least one locking arm may include a lower locking arm pivotally connected to the lower leg and an upper locking arm pivotally connected to the upper leg. The at least one locking arm may be movable between retracted and extended positions and a securing mechanism provided on the bracket body for securing the at least one locking arm in the retracted position.

The mounting bracket may include a lock box engaging element mounted on the exterior portion for secure engagement by a lock box. Alternatively, the lock box may be fixedly connected or attached to the exterior portion of the bracket to form an integrated assembly.

The present invention also provides a lock box mounting bracket including a unitary bracket body wherein the exterior portion, the interior portion and the edge portion are integrally connected to form the unitary bracket body. A bracket locking device is formed on the interior portion to permit the bracket body to be securely connected to the door hinge to prevent unauthorized removal of the lock box mounting bracket when the door is in both the open and closed positions. The unitary bracket body may also include the lock box engaging element formed integrally with the unitary bracket body. In addition, the unitary bracket body may also include an integrated lock box protection feature integrally connected to the body. Whether the lock box is removably connected to the bracket body or integrally attached, the lock box may include a compartment for containing a key and an electrically actuated access control system for selectively permitting access to the compartment. The electrically actuated access control system may include a reader device connected to the lock box and a power source formed separately from the reader device and removably connectable to the lock box.

The present invention is also directed to a lock box mounting bracket including a bracket body having an exterior portion positioned in the exterior space when the lock box mounting bracket is mounted on the door for supporting a lock box, an interior portion positioned in the interior space when the lock box mounting bracket is mounted on the door and an edge portion connecting the exterior portion to the interior portion and positioned along the hinge-edge of the door when the mounting bracket is mounted on the door. The bracket also includes a lock box protection device positioned on the bracket body for preventing damage to the lock box and a bracket locking device formed on the interior portion and positioned in the interior space. A lock box engaging element may also be provided on the exterior portion for secure engagement by the lock box. The exterior portion may include a back plate extending along the exterior side of the door and the lock box protection device may include a side wall positioned a spaced distance along the back plate from the edge portion. The side wall extends outwardly from the back plate a distance equal to at least a side width extent of the lock box. The lock box protection device may further include a shield mounted on one of the lock box engaging element and the bracket body. The lock box engaging element may be positioned between the shield and the back plate wherein the shield is positioned immediately adjacent the lock box engaging element and sized to shield a substantial portion of the lock box shackle when mounted on the lock box engaging element. Preferably, the shield is connected to both the side wall and the lock box engaging element. The lock box protection device may further include at least one transverse projection positioned a spaced distance from the shield. The at least one transverse projection preferably includes two transverse projections connected to and extending from the side wall.

DETAILED DESCRIPTION OF THE PRESENT INVENTION

Figure 1:
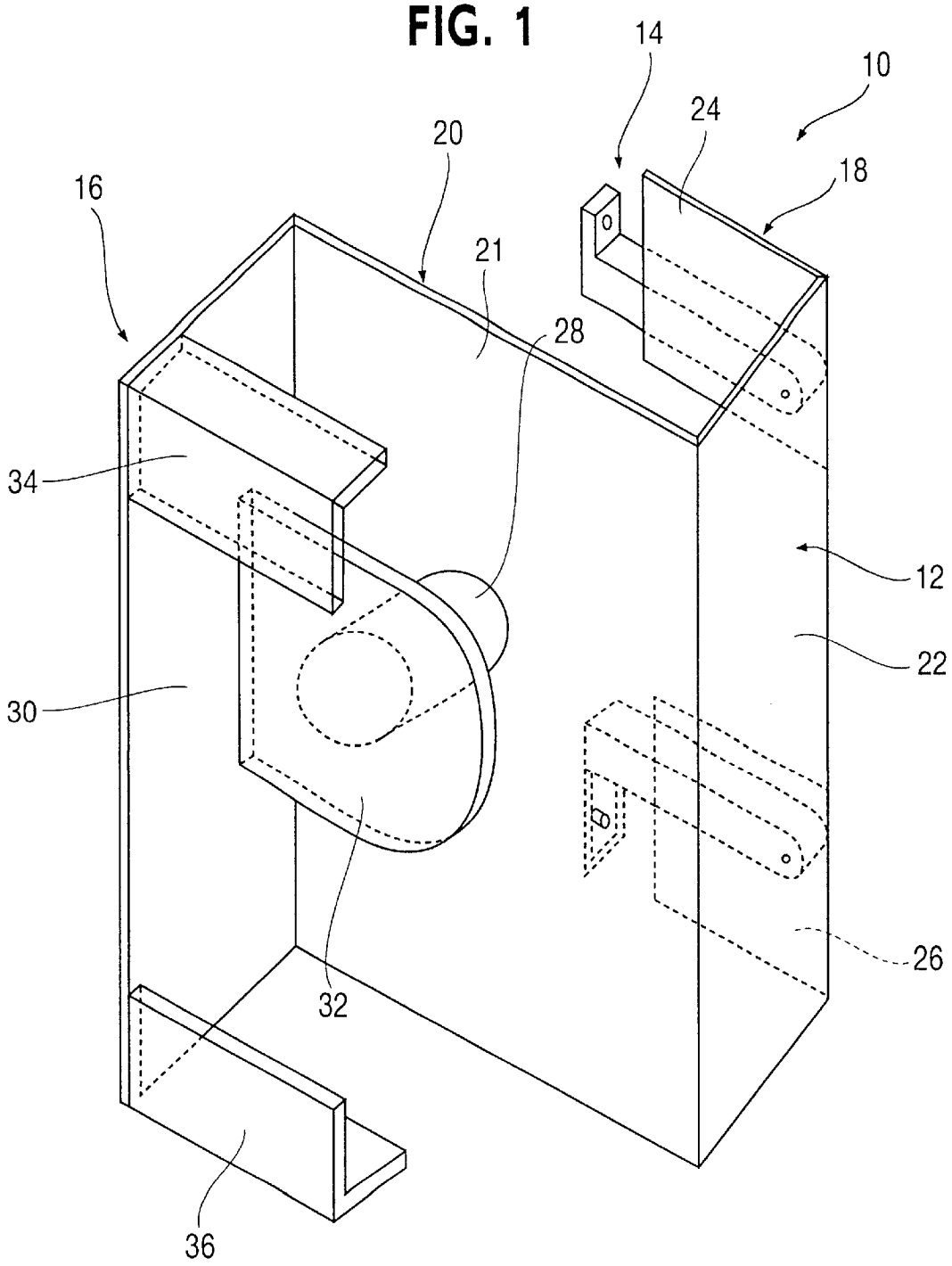
FIG. 1 is a perspective view illustrating a lock box mounting bracket in accordance with embodiment of the present invention.

Referring to FIG. 1, there is shown a preferred embodiment of the lock box mounting bracket of the present invention, indicated generally at 10, which effectively minimizes the likelihood of unauthorized access to the interior of a lock box by protecting the connection between the lock box and mounting bracket 10 while importantly creating a more secure, isolated connection between bracket 10 and a door. In its most basic form, lock box mounting bracket 10 includes a bracket body 12 shaped to fit on the hinge-edge of a door 4 mounted on a hinge 6, and a lock box locking device 14 mounted on bracket body 12 for permitting secure locking of body 12 to hinge 6 while preventing unauthorized removal of lock box mounting bracket 10 when door 4 is in both the open and closed positions. As discussed more fully hereinbelow, lock box mounting bracket 10 also preferably includes a lock box protection device or feature 16 connected to bracket body 12 for preventing damage to lock box 2 or other elements mounted on the front of bracket body 12 as discussed more fully hereinbelow. Thus lock box mounting bracket 10 of the present invention effectively protects the lock box connection and other elements mounted on the exterior side of bracket body 12 while minimizing the likelihood of unauthorized personnel removing lock box mounting bracket 10 from door 2.

Figure 2:
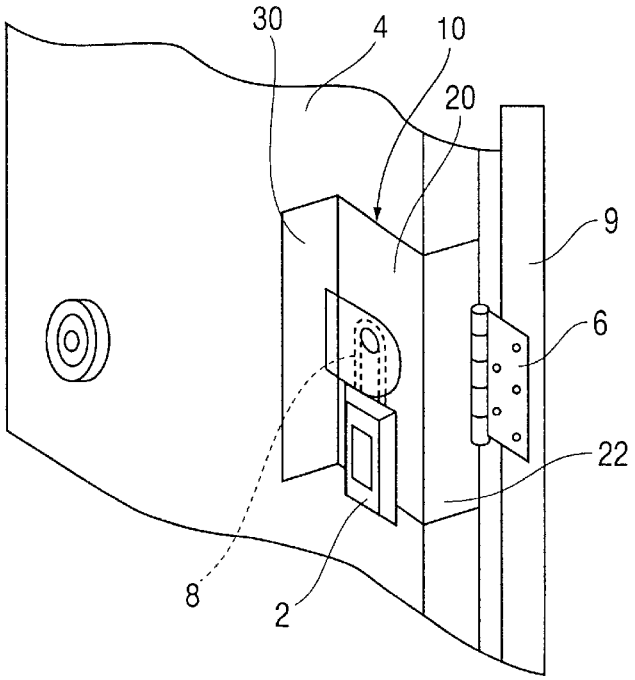
FIG. 2 is a perspective view illustrating a lock box mounting assembly and lock box mounted to the hinge-edge of a door in accordance with a second embodiment of the present invention.
Figure 3:
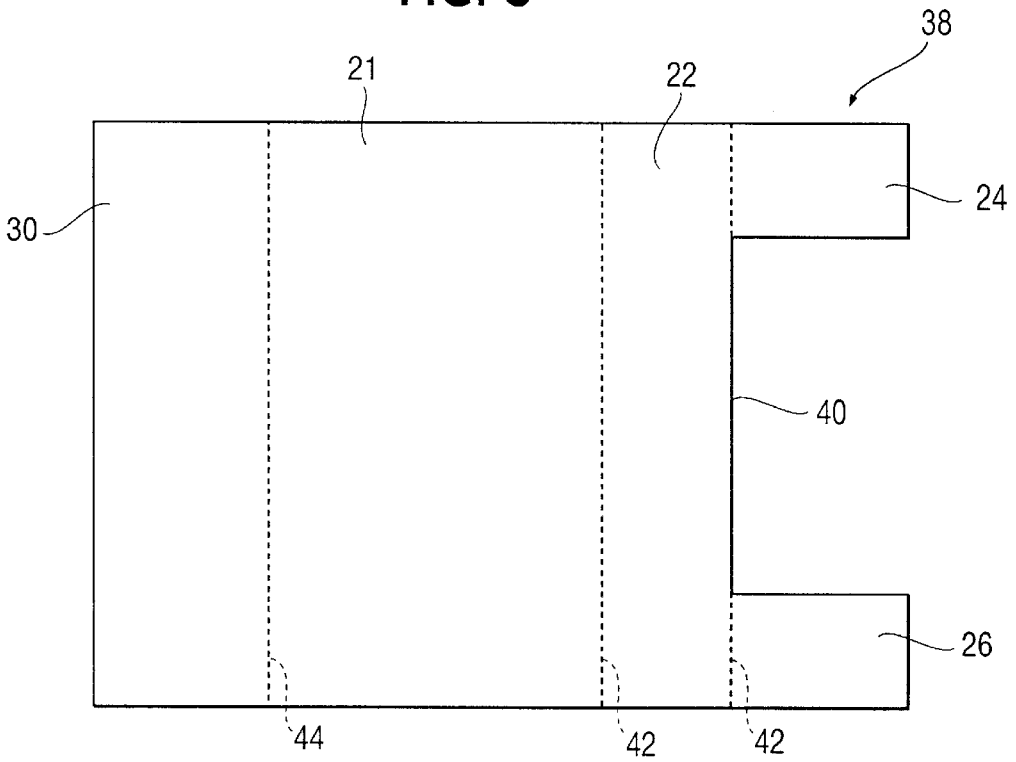
FIG. 3 is a plan view of a sheet metal member prior to bending to form the bracket body of the embodiments of FIGS. 1 and 2.
Figure 4A:
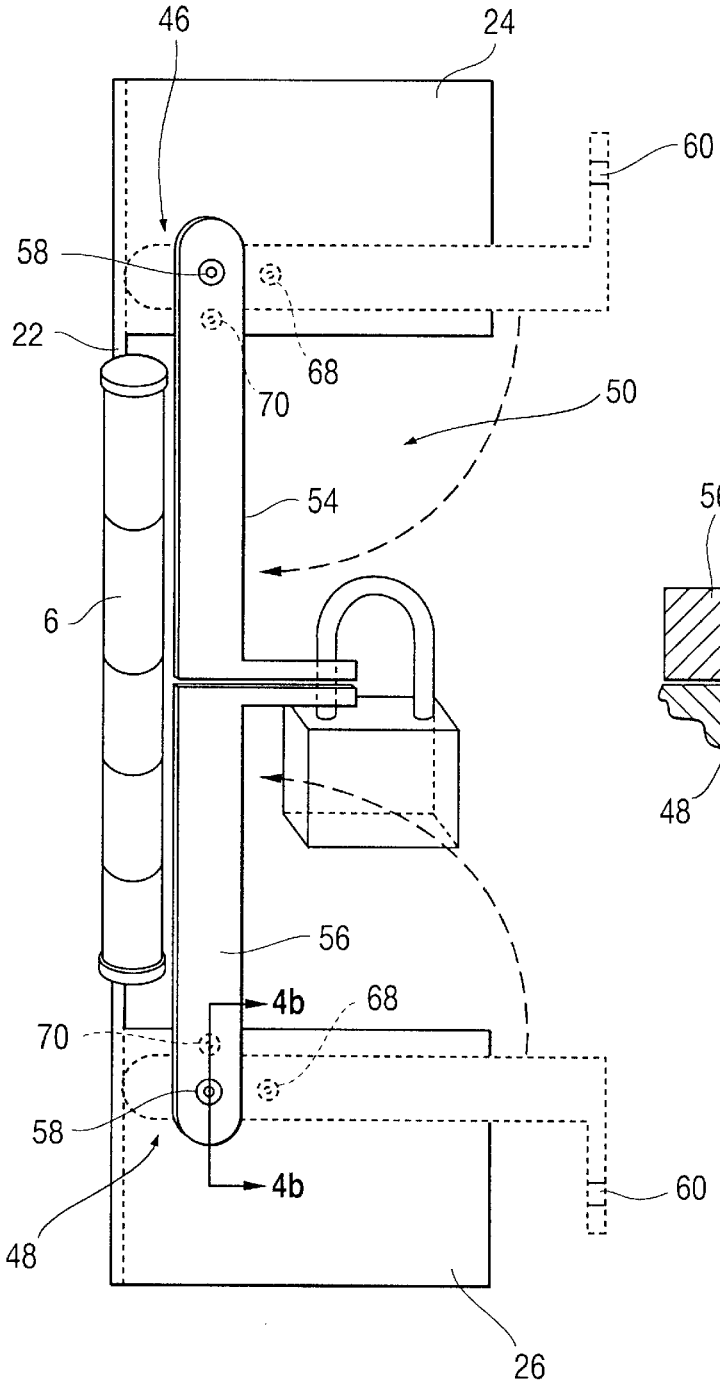
FIG. 4*a* is a rear elevation view of the lock box mounting assembly of the present invention mounted on the hinge-edge of a door showing one embodiment of the bracket locking device of the present invention.

Referring to FIGS. 1 and 3, bracket body 12 includes an interior portion 18 for positioning on an interior side of door 4, an exterior portion 20 including a back plate 21 for positioning on an exterior side of door 4 and an edge portion 22 for positioning along a hinged-edge of door 4 when lock box mounting bracket 10 is mounted on door 4 as shown in FIG. 2. As best shown in FIGS. 1, 3 and 4*a*, interior portion 18 includes an upper leg or section 24 extending transversely across the door above hinge 6 and a lower leg or section 26 extending across the interior side of door 4 below hinge 6 when mounting bracket 10 is mounted on door 4. Bracket locking device 14 is formed and/or connected to upper section 24 and lower section 26 to prevent secure locking of bracket body 12 around hinge 6 as discussed more fully hereinbelow. Upper and lower sections 24, 26 respectively, are spaced apart a distance necessary to permit positioning of a conventionally sized hinge 6 between sections 24, 26. The mounting bracket may include an adapter to permit mounting on non-standard or irregular sized door/hinge applications by, for example, increasing the distance between the sections 24, 26. Likewise, an adapter for permitting mounting on doors having a greater than standard thickness could be provided. Likewise, the bracket sections may be shaped or adapted to mount on doors having unusual features.

As shown in FIG. 1, the present embodiment of lock box mounting bracket 10 may also include a lock box engaging element 28 securely mounted to and extending outwardly from back plate 21 of exterior portion 20 for engagement by a shackle 8 of lock box 2 as shown in FIG. 2. Lock box engaging element 28 includes a round shaft around which shackle 8 is mounted. Alternatively, lock box engaging element 28 may be in the form of a conventional eye element (not shown) or any other securely mounted extension capable of being engaged by the lock box shackle 8. Lock box engaging element 28 is secured to back plate 21 by, for example, a weld, a threaded connection or any other rigid secure connection. As discussed more fully hereinbelow, lock box engaging element 28 is not needed in other embodiments where lock box 2 is integrally formed on exterior portion 20.

Referring to FIGS. 1 and 2, lock box protection device 16 includes a side wall 30 protruding outwardly from back plate 21 a spaced distance from edge portion 22. Side wall 30 functions to protect lock box engaging element 28 and lock box 2, especially shackle 8, from burglary tools entering from the outer side of mounting bracket 10 for the purpose of damaging and breaking the lock box walls or shackle by forcible impact, cutting, drilling etc. Lock box protection device 16 also includes a shield 32 connected to side wall 30 and extending transversely parallel to the back plate. Shield 32 is rigidly connected to lock box engaging element 28 and sized to cover all or a substantial portion of shackle 8 when lock box 2 is mounted on lock box engaging element 28. Shield 32 is generally formed from a "D" shaped piece of steel plate to allow the lock box 2 to rotate 180° on the round shaft engaging element 28 when transferring mounting bracket 10 from a right-handed door to a left-handed door and vice versa. In this way, the lock box does not have to be removed from mounting bracket 10 during the transfer. This feature would also extend the life of the shackle components by significantly reducing wear associated with the constant removal/installation inherent in conventional assemblies. It should be noted that access to lock box engaging element 28 and lock box 2, especially shackle 8, from the side of the bracket opposite side wall 30 is limited by the bracket's close proximity to the door jamb and frame assembly 9 as shown in FIG. 2.

As shown in FIG. 2, lock box protection device 16 may include only side wall 30 and shield 32. However, referring to FIG. 1, lock box protection device 16 also preferably includes first and second transverse projections 34 and 36 respectively, fixedly attached to side wall 30 and extending transversely across bracket body 20 in front of shield 32. Preferably, first transverse projection 34 is positioned at an upper corner of side wall 30 while second transverse projection 36 is positioned at the lower corner of side wall 30 to allow insertion, use and removal of a lock box, or an electronic key pad for operating a lock box. First and second transverse projections 34, 36 also offer protection to the lower body portion of the lock box from the blunt force of burglary tools and subsequent damage to mechanical/electronic components, while reducing accessibility to the key storage area of the lock box by chisels, drills, etc. Of course, first and second transverse projections 34, 36 could extend toward door frame 9 any distance necessary to achieve the desired protective affect. First and second transverse projections 34, 36 are preferably formed of a piece of "angle iron" steel welded to the ends of side wall 30 perpendicular to the side wall plane. The use of an angle iron causes transverse projections 34, 36 to desirably potentially block access through both the top, bottom and front.

Referring to FIG. 3, bracket body 12 is preferably formed from a unitary or continuous monolithic sheet metal member 38 having a generally rectangular shape with a hinge receiving slot 40 formed on one side to define upper and lower sections 24 and 26. Sheet metal member 38 is folded along fold lines 42 to form U-shaped bracket body 12 as shown in FIG. 1. In the preferred embodiment, side wall 30 is also provided and formed integrally with sheet metal member 38. Side wall 30 is formed by folding sheet metal member 38 along fold line 44 in the appropriate direction to form the unitary, integral assembly as shown in FIG. 1. Preferably, sheet metal member 38 is formed from a heavy-gauge type steel such as No. 304 stainless steel. A protective liner, such as felt, may be provided on the inner surface of bracket body 12 facing door 4 to protect the door finish from possible scratches during insertion/removal. Importantly, the unitary structure of sheet metal member 38 permits the integrated bracket body 12 and lock box protection device 16 to be formed simply and easily and with minimal cost and time.

Figure 4B:
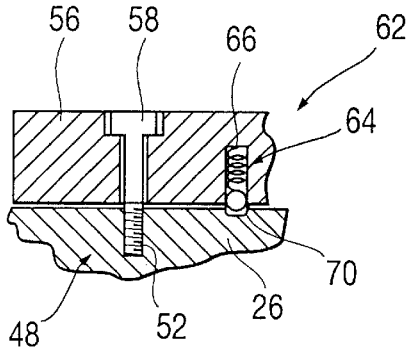
FIG. 4*b* is an exploded partial cross sectional view of the connection between the rocking arm and interior portion of the bracket body taken along plane 4*b*—4*b* FIG. 4*a* showing a securing mechanism for securing the arm in a given position.

Referring now to FIGS. 4*a* and 4*b*, bracket locking device 14 includes a first connector portion 46 formed on upper section 24, a second connector portion 48 formed on lower section 26 and a connecting device 50 for connection to first and second connector portions 46, 48. In the embodiment shown in FIG. 4*b*, first and second connector portions 46 and 48 each include an aperture 52 formed in the respective section for enabling pivotal connection to connecting device 50. Connecting device 50 includes an upper locking arm 54 mounted on upper section 24 at first connector portion 46 and a lower locking arm 56 mounted on lower section 26 at second connector portion 48. Specifically, as shown in FIG. 4*b*, upper and lower locking arms 54 and 56 are pivotally connected to the respective upper and lower sections 24 and 26 by a shoulder screw 58 positioned in a through-hole formed in one end of the respective arm. Shoulder screw 58 threadably engages aperture 52 formed in the respective section to pivotally connect the arm to the respective section of the interior portion 18 of bracket body 12. Upper and lower locking arms 54, 56 are generally L shaped and pivotally mounted for movement between a retracted position shown in dashed lines in FIG. 4*a* and an extended position for locking mounting bracket 10 to hinge 6. Each upper and lower locking arm 54 and 56 includes a lock hole 60 formed in its distal end. Movement of upper and lower locking arms 54, 56 into the extended position causes lock holes 60 to align to permit the insertion of a locking device, such as a standard padlock requiring a key or combination. It should be noted that apertures 52 are positioned relative to edge portion 22 so as to cause upper and lower locking arms 54 and 56 to be positioned immediately adjacent hinge 6 when in the extended position as shown in FIG. 4*a*. This arrangement minimizes the relative movement permitted between bracket body 12 and hinge 6 thereby creating a more secure connection and mounting on door 4.

The use of connecting device 50 having upper and lower retractable locking arms 54 and 56, respectively, creates a compact mounting bracket and locking device assembly which can be easily installed onto door 4 and hinge 6 and effectively locked into position with minimal effort. Bracket locking device 14 also includes a securing mechanism 62 for securing upper and lower locking arms 54, 56 in each of the retracted and extended positions. Securing mechanism 62 includes a spring biased ball bearing assembly 64 positioned in a cavity 66 formed in the inner surface of each of upper and lower locking arms 54, 56. Securing mechanism 62 also includes a first indentation 68 formed in the outer surface of each of the upper and lower sections 26 adjacent aperture 52 and a second indentation formed in the outer surface of upper and lower sections 24 and 26, 90° from first indentation 68 as shown in FIG. 4*a*. In this manner, when upper and lower locking arms 54 and 56 are moved into the retracted position, spring biased ball bearing 64 slides along the outer surface of the respective upper and lower section into positive engagement with first indentation 68 thereby securing the locking arm in the retracted position and preventing the locking arms from swinging during assembly.

Likewise, when the locking arm is moved into the extended position, the ball bearing assembly 64 engages second indentation 70 to secure the respective locking arm in the extended position resulting in the alignment of lock holes 60 and permitting simple and easy insertion of a locking device through the aligned lock holes 60.

Figure 5:
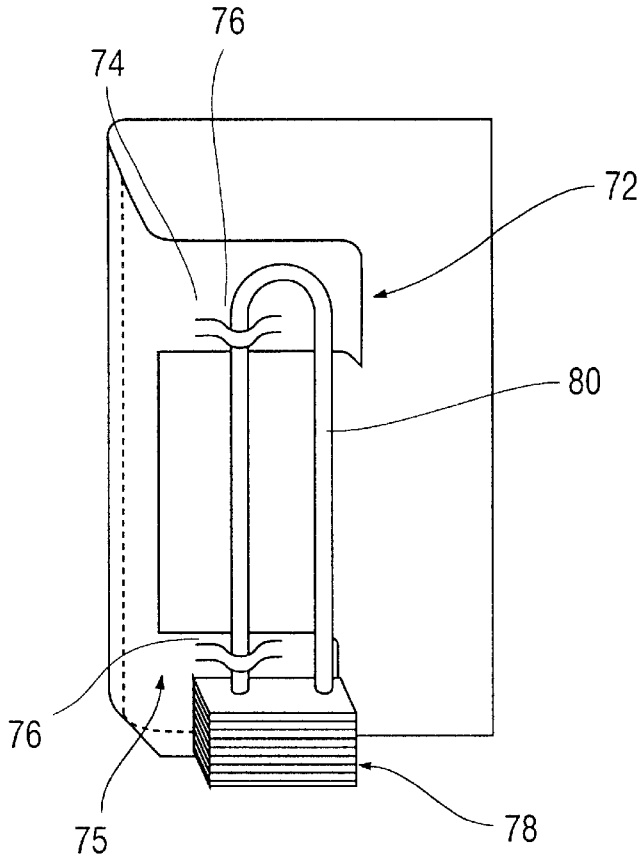
FIG. 5 is a perspective view of the lock box mounting assembly of the present invention illustrating a second embodiment of the bracket locking device.
Figure 6:
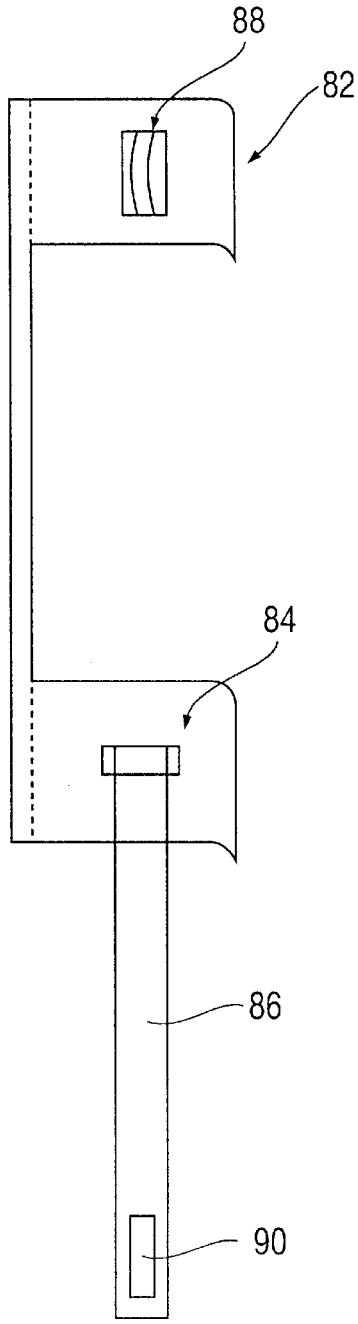
FIG. 6 is a rear elevation view of the interior portion of the bracket of the present invention showing yet another embodiment of the bracket locking device.

Of course, it should be recognized that bracket locking device 14 may be in the form of any locking device capable of effectively securing bracket body 12 around hinge 6 in a lockable manner to prevent unauthorized removal of mounting bracket 10 when the door is in both the open and closed positions. For example, as shown in FIG. 5, a bracket locking device 72 may be provided which includes first and second connector portions 74 and 75, respectively, provided with an opening 76 for receiving connecting device 50. Openings 76 may be formed by cutting and bending a strip of upper and lower sections 24, 26. In this embodiment, connecting device 50 may be a conventional padlock 78 having an elongated shackle 80 extending through openings 76. Alternatively, it is shown in FIG. 6, a bracket locking device 82 may include a second connector portion 84 including any type of pivotal connection for permitting a locking arm 86 to be connected to lower section 26 and pivoted in a plane perpendicular to the plane extending through upper and lower sections 24, 26. Bracket locking device 82 also includes a first connector portion 88 formed on upper section 24 for securely connecting locking arm 86 to upper section 24. For example, first connector portion 88 may include a loop connected to or formed in upper section 24 and extending outwardly therefrom. In this case, locking arm 86 includes a slot 90 for receiving the loop when locking arm 86 is moved into the engaged position. The loop extends through slot 90 a sufficient distance to permit the insertion of a padlock through the loop thereby securing locking arm 86 in the engaged position and preventing unauthorized removal.

Figure 8:
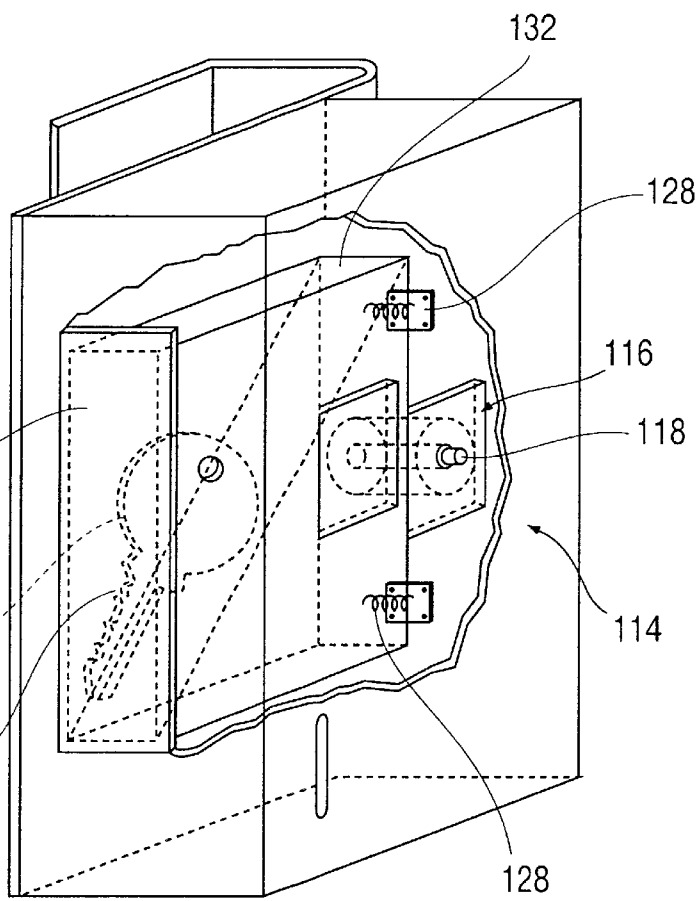
FIG. 8 is a partial cross sectional view of the lock box mounting assembly of FIG. 7 showing the lock box internals.
Figure 7:
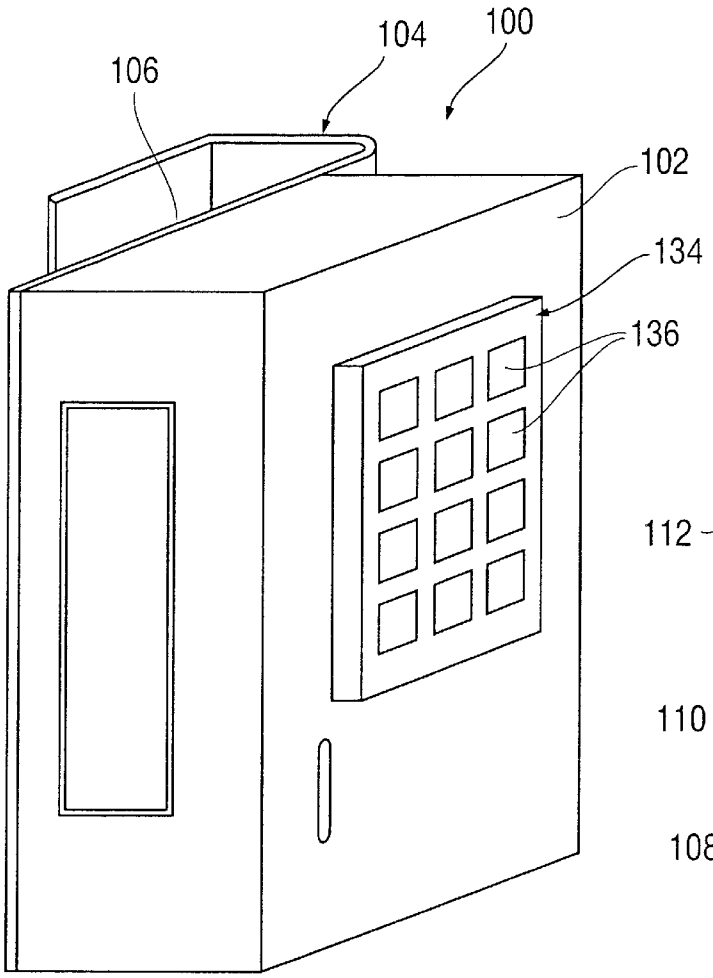
FIG. 7 is a perspective view of another embodiment of the lock box mounting assembly of the present invention including an integrated lock box.
Figure 9:
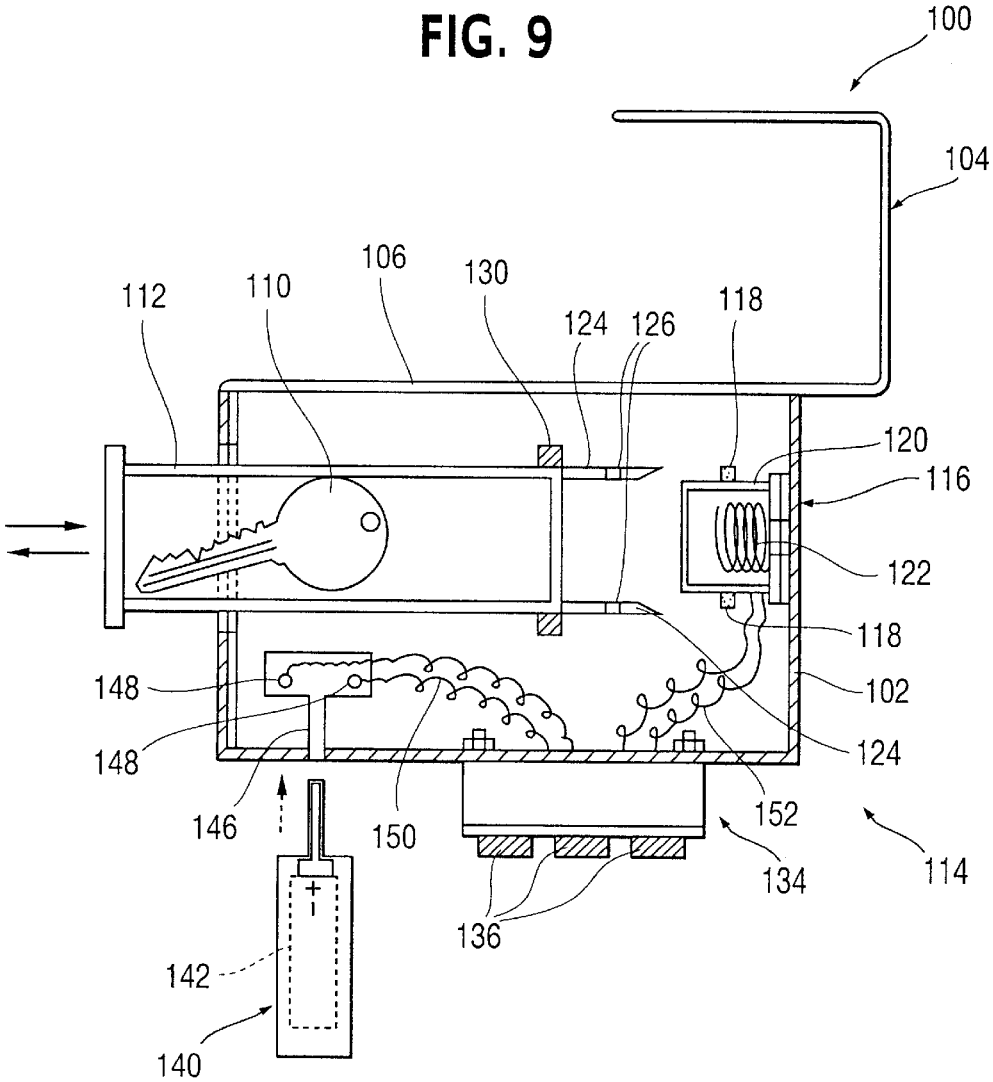
FIG. 9 is a top cross sectional view of the lock box mounting assembly of the present invention showing the key compartment and access control system.

FIG. 7 illustrates another embodiment of the present lock box mounting bracket indicated generally at 100 which includes a lock box 102 integrally connected or formed on bracket body 104, for example, by welding. Lock box 102 includes five side walls which together with back plate 106 form a compartment 108 containing a key 110. Lock box mounting bracket 10 may include any of the previously disclosed bracket locking devices mounted on the interior portion 18 of the bracket for lockably securing the bracket to a hinge. Lock box 102 includes a key storage chamber or drawer 112 capable of being selectively actuated by authorized personnel to permit access to key 110. This selective control over the access to key 110 is accomplished using an electrically actuated access control system 114 for selectively releasing key storage drawer 112 to authorized personnel. Key storage drawer 112 is mounted in a vertical position as shown in FIG. 8 for sliding movement along guides, tracks, linear bearings or other registering components (not shown). Key storage drawer 112 includes an outer face positioned flush with the side wall of lock box 102 when key storage drawer 112 is in a closed position as shown in FIG. 8. Key storage drawer 112 is movable into an open position as shown in FIG. 9 to permit access to key 110. As shown in FIG. 8, key storage drawer 112 includes a diagonal dividing wall 132 running from the lower front to the upper rear to divide the drawer into two chambers. This design allows the entire assembly to be universally applied for right and left opening doors simply by rotating the entire unit 180° while maintaining a correct upwardly facing key chamber. Thus, as is apparent, the lower portion of drawer 112 as shown in FIG. 8 is open. Of course, the device could be provided with two drawers, one for each position. In this case, a switch, such as a mercury switch, could be used to open only the appropriate drawer corresponding to the position.

As shown in FIGS. 8 and 9, electrically actuated access control system 114 includes a solenoid actuated drawer securing device 116 including a spring biased projection 118 positioned on each side of a housing 120 containing a solenoid actuator 122. Key storage drawer 112 includes two side wall extensions 124 extending from the rear of drawer 112 for positioning on either side of solenoid actuator 122 when drawer 112 is moved into the closed position as shown in FIG. 8. Each extension 124 includes an aperture or groove 126 positioned for engagement by the respective projection 118. When drawer 112 is in the closed position, each projection 118 is biased outwardly to engage a respective aperture 126 thereby locking drawer 112 in the closed position. Upon actuation of solenoid actuator 122, projections 118 are moved inwardly toward solenoid actuator 122 permitting the release of drawer 112. Importantly, projections 118 are positioned in the front and the rear of lock box 102 to more effectively minimize the likelihood of manually opening drawer 112. This unique positioning of projections 118 minimizes the likelihood that projection 118, located in the rear of lock box 102, could be manually activated by drilling a hole in the lock box and inserting a tool. As shown in FIG. 8, drawer biasing springs 128 are provided to bias drawer 112 into the open position so that upon actuation of solenoid actuator 122, drawer 112 will automatically move into the open position. Key storage drawer 112 also includes drawer stops 130 positioned on each side of drawer 112 for engaging the side wall of lock box 102 to limit the extent of the open position.

Figure 11:
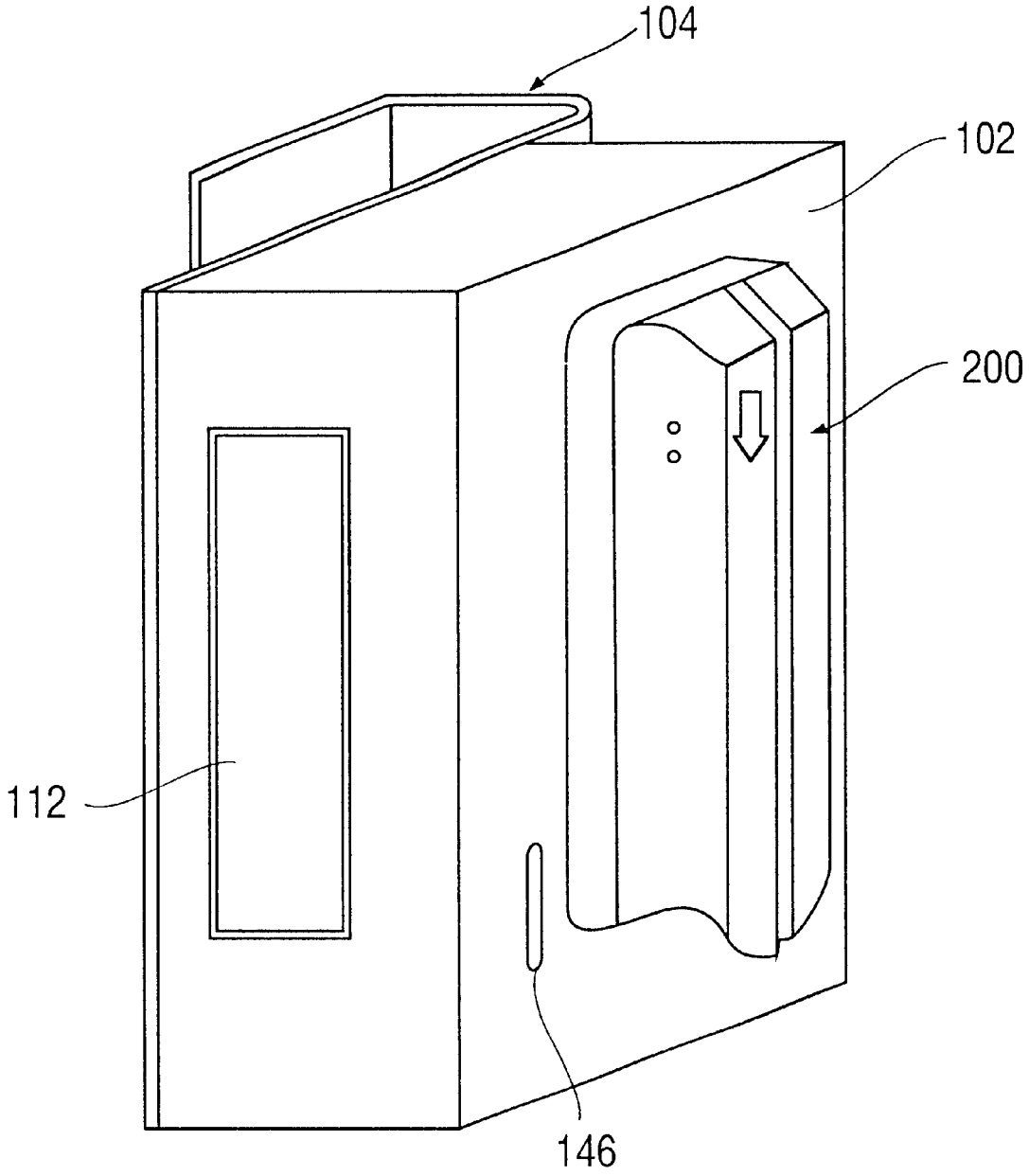
FIG. 11 is a perspective view of yet another embodiment of the lock box mounting as of the present invention including an integrated lock box.

Electrically actuated access control system 114 further includes a reader device 134 for actuating solenoid actuator 122 only upon the receipt of specific identification information from a user. For example, as shown in FIG. 9, reader device 134 may be in the form of an electronic key pad for receiving and reading a coded pin number entered by pushing keys 136 to cause an electrical signal to be sent to actuator 122. FIG. 11 illustrates another embodiment of the present invention including a reader device 200 including a magnetic card reader for permitting an authorization card having a magnetic strip to be swiped through the device 200 to positively identify the user. Of course, other access control card technologies may be used including Wiegand-effect, proximity (active/passive), barium ferrite and smarts/intelligence cards. Moreover, other access control devices could release the key by means of biometrics, bar code readers, optical key, Wiegand key or remote key pads. Likewise, a combination of reader technologies could be used, such as the commercially available combination Wiegand card/keypad pin number reader. Whatever the method of authorization, upon reading the correct authorization information, an electrical signal is forwarded to solenoid actuator 122 which responds by pulling projections 118 inwardly causing drawer 112 to move outwardly thereby dispensing the key. Preferably, the reader device is capable of providing an audit trail by storing information relating to each of a predetermined number of users.

Figure 10:
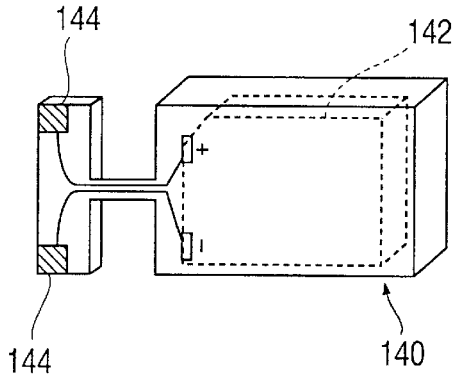
FIG. 10 is a side perspective view of the transportable power key of FIG. 9.

In the preferred embodiment as shown in FIG. 9, electrically actuated access control system 114 also includes a remote, removable power key 140 for providing the electrical power to operate reader device 134 and solenoid actuator drawer securing device 116. As shown in FIGS. 9 and 10, power key 140 houses a battery 142 and includes two electrical contacts 144 formed on a key end of the power key. Preferably the power key also includes a push button switch to activate the contacts. Lock box 102 includes a key way 146 formed in its front wall for receiving the key end of power key 140. Preferably, the key end and the key way 146 are formed with a complementary proprietary shape to add another degree of access resistance. Key way 146 extends inwardly to a recessed set of electrical contacts 148 positioned for engagement by contacts 144. The key way and key end may be in the form of a conventional "twist and lock" device. Thus, the key end of power key 140 is inserted into key way 146 and rotated to cause contacts 144 to engage contacts 148 thereby supplying power to the electrical circuitry 150 leading to reader device 134. Once the electrical contact is made, reader device 134 would be operative and ready to verify the identity of the user and, if the identity is properly verified, complete the electrical contact between circuitry 150 and circuitry 152 to supply electrical power to solenoid actuator 122 to permit release of drawer 112. The electrical circuitry is configured to hold in memory the necessary identification data while lock box 102 is idle without power. The use of a separate removable power key advantageously places the responsibility on each user to maintain the charge of their own battery thereby eliminating the possibility of an onboard "box unit" battery being fully discharged and requiring service. Also, the power key design safeguards against lost or stolen access-control badges, cards, keys etc. being used fraudulently. The battery voltage may be in the 5–12 volt DC range and a common size readily available. This voltage corresponds to industry standards for access control readers and related circuitry, as well as widely available DC solenoids. It should be noted that an alternative embodiment could include a removable keypad with an integrated power supply. In addition, the power key may also consist of a connector that plugs into a tamper-proof recessed receptacle on the face of the attachment to the bracket. A signal carrying wire may extend from the connector for attachment to a remote keypad and battery source. The reader would be carried by the agent and plugged in to provide identity authorization and key access. This alternative may keep the reader out of the "elements" and remove the possibility of tampering or vandalism to the reader.

The mounting bracket may also be provided with an integral depository structure in the form of a high-security receptacle for receiving a door key for entrance to the building. Access to the interior of this receptacle may also be determined by a "reader". The enclosed key could be secured to a length of thin steel cable secured to the interior side of the depository structure. The result of this arrangement would be a key to the building that could not be removed from the premises for possible duplication.

Figure 12A:
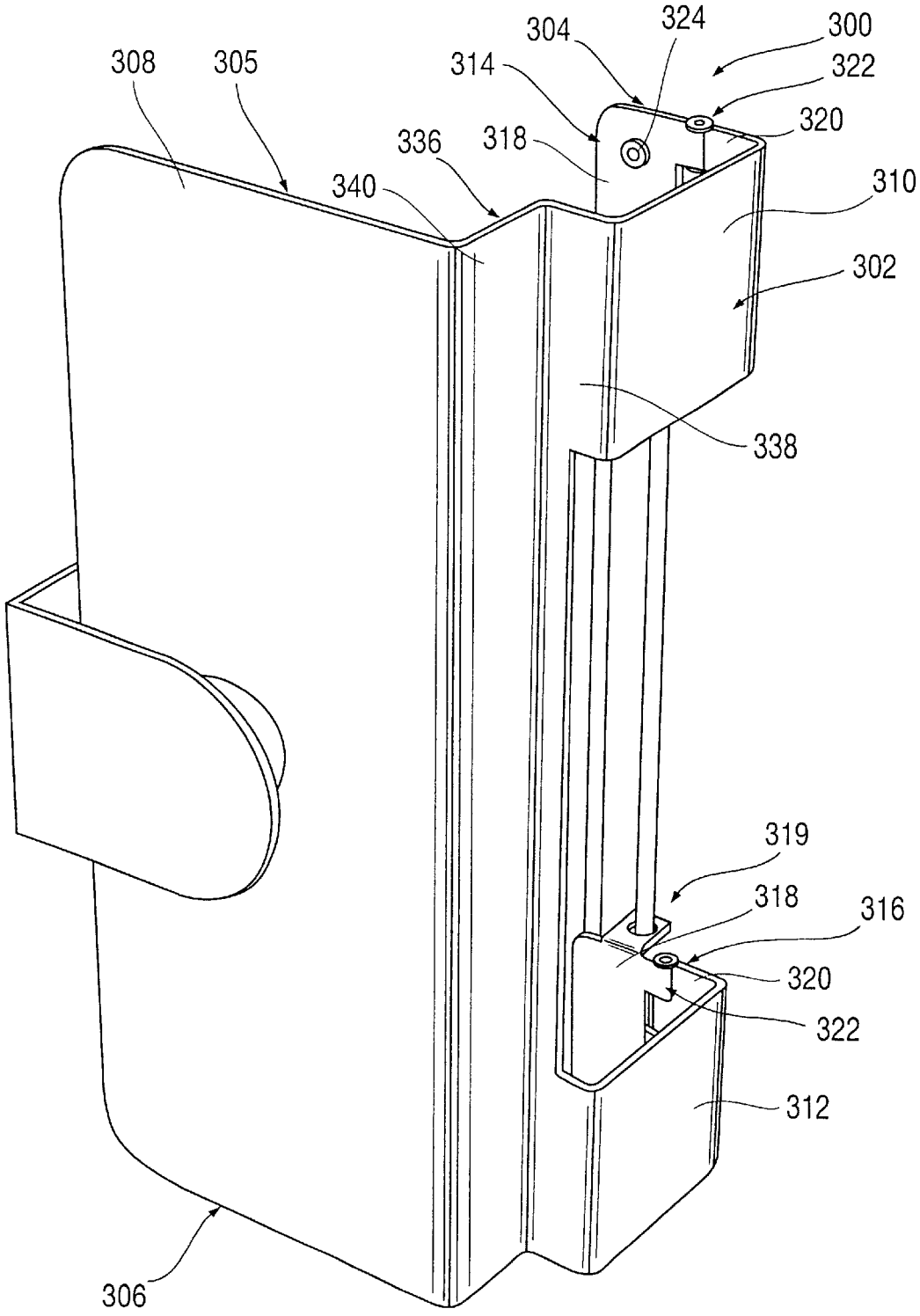
FIG. 12*a* is a perspective view on one side of yet another embodiment of the lock box mounting bracket of the present invention.
Figure 12B:
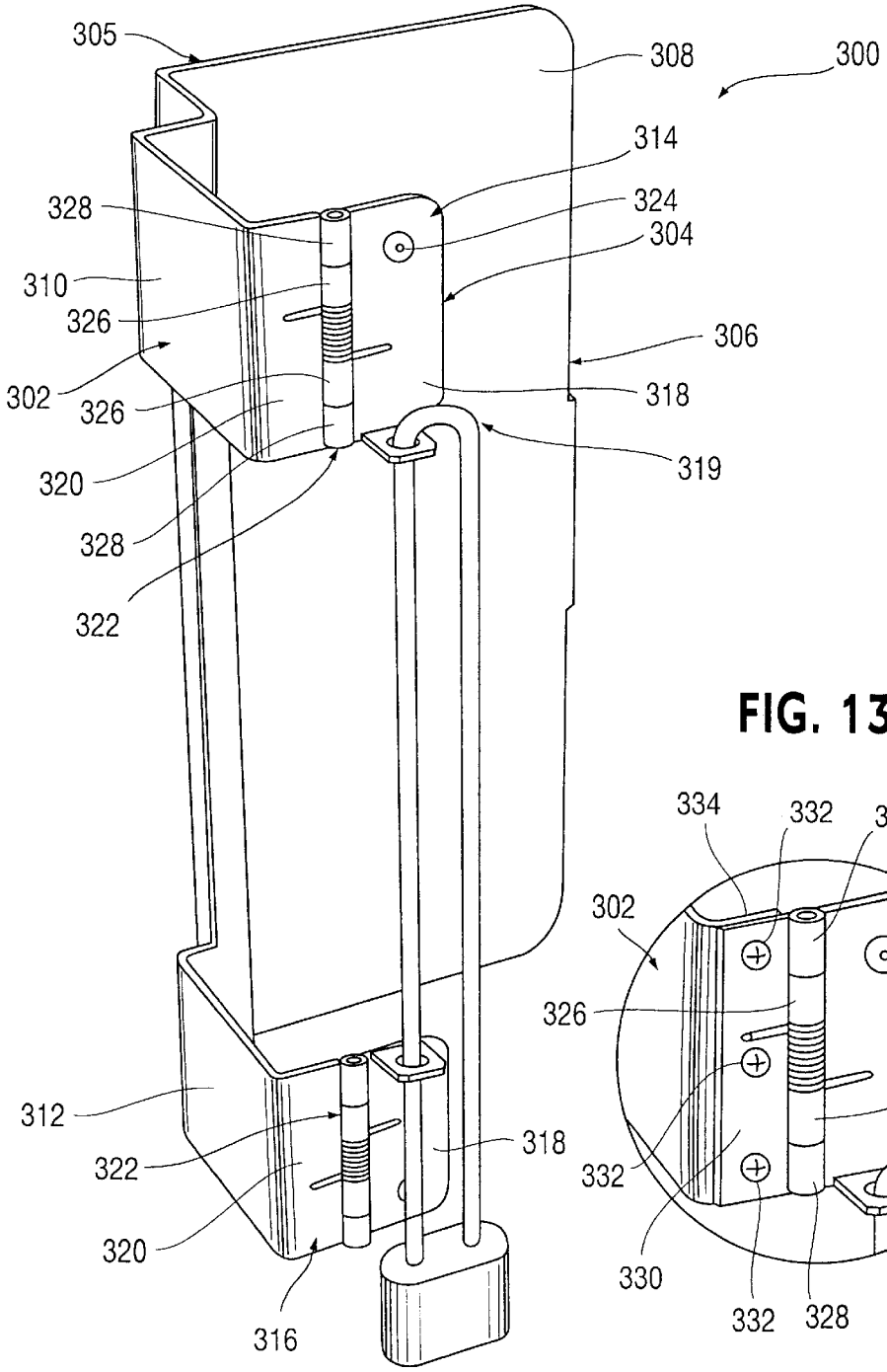
FIG. 12*b* is a perspective view of an opposite side of the lock box mounting bracket of FIG. 12*a*.

Referring to FIGS. 12*a* and 12*b*, another embodiment of the lock box mounting bracket of the present invention is illustrated which advantageously can be mounted on the exterior hinge-pin assembly of an out-swing door unlike the previous embodiments, but locked on the interior side of the door as described in the previous embodiments. As is well known, many doors, especially in commercial applications, are mounted on hinge-pin assemblies so as to swing outwardly toward the exterior of a building or other space to be locked. In the out-swing door design, the hinge-pin assemblies are positioned on the exterior side of the door and thus on the same side as the exterior portion of the lock box mounting bracket. The lock box mounting bracket 300 of the present embodiment permits easy mounting on an out-swing door by including a bracket body 306 having an edge portion 302 modified from the previous designs described hereinabove so as to accommodate the hinge-pin assembly. In addition, lock box mounting bracket 300 includes an interior portion 304 and an exterior portion 305 designed to permit the mounting bracket to be moved into position on the door with ease and without binding while permitting effective locking of the bracket. The present embodiment is similar to the previous embodiments in that exterior portion 305 includes a back plate 308 having a device for mounting a lock box. The device may include a shackle or the lock box may be integrally formed on the back plate 308. Any of the other lock box protection devices discussed hereinabove may be used with the present embodiment.

Edge portion 302 includes an upper edge section 310 connected to interior portion 304 and positioned above a door hinge (not shown). Edge portion 302 also includes a lower edge section 312 positioned below the door hinge (not shown). Upper edge section 310 and lower edge section 312 are positioned a spaced distance apart equivalent to at least the height of the door hinge so as to accommodate the hinge while mounting the bracket 300 on the door. As a result, the interior portion 304 of mounting bracket 300 and edge sections 310 and 312 can be slid around the door on upper and lower sides of the door hinge and moved into the appropriate position on the door so as to position the door hinge adjacent one side of back plate 308.

Figure 13:
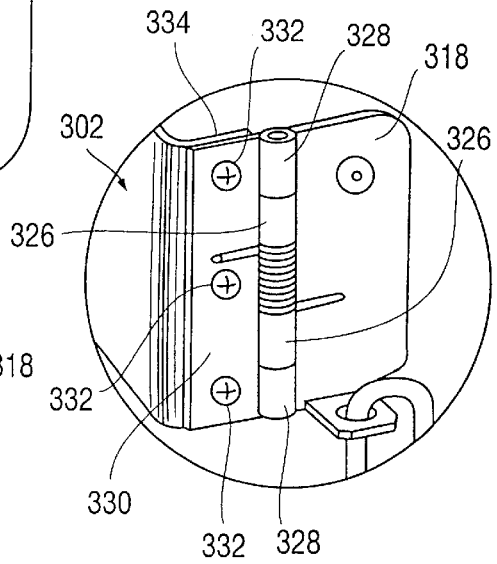
FIG. 13 is an exploded view of an alternative embodiment of the bracket locking device and pivot hinge of FIGS. 12*a* and 12*b*.

Interior portion 304 includes an upper leg 314 and a lower leg 316 having respective pivot portions 318 comprising part of a bracket locking device 319. Each pivot portion 318 is pivotally connected to a fixed portion 320 of upper and lower legs 314, 316 by a spring biased pivot hinge 322. Each spring biased pivot hinge 322 permits the respective pivot portion 318 to pivot in either direction around the pivot hinge 322 thereby, importantly, permitting lock box mounting bracket 300 to be slipped over the hinge-pin assembly of an out-swing door. Each pivot portion 318 is biased by pivot hinge 322 into the position shown in FIG. 12*b*. Each pivot portion 318 may include a cushion piece 324 for preventing damage to the door. It should be noted that fixed portions 320 include integral hinge sections 326 for meshing with integral hinge sections 328 formed on pivot portions 318. As shown in FIG. 13, in an alternative embodiment, hinge sections 326 may be formed on a hinge plate 330 fastened, for example by screws 332, to fixed portion 334. In this embodiment, fixed portion 334 does not include any hinge sections 326. As a result, bracket body 306 may be more easily manufactured and the hinge plates 330 and pivot portions 318 separately manufactured and connected to bracket body 306.

In the present embodiment for mounting on the hinge-pin assembly side of out-swing doors, the exterior portion of bracket body 306 includes an L-bend 336 connecting edge portion 302 to back plate 308. L-bend includes a first bend portion 338 for positioning along the face of a door and a second bend portion 340 extending outwardly from first bend portion 338 to connect with back plate 308. Second bend portion 340 may extend at any appropriate angle from first bend portion 338 so as to enable the mounting of bracket 300 on the hinge-pin assembly side of the door. L-bend 336 positions back plate 308 a spaced distance from the door when the bracket 300 is in position but, more importantly, creates enough space for bracket 300 to be easily moved into position around the edge of the door.

Accordingly, the lock box mounting bracket 10, 100 of the present invention results in many advantages over existing conventional lock box mounting assemblies. First, importantly, lock box mounting bracket 10, 100 effectively minimizes the likelihood of unauthorized access to a lock box by providing a bracket locking device mounted on the interior portion of the mounting bracket in the interior space while also providing a lock box protection device for thwarting efforts to breach the lock box compartment and/or break the lock box shackle. Bracket locking device 14, 72, 82 effectively locks the bracket onto the hinge of the door so that the bracket cannot be removed when the door is in the closed position. Moreover, even with the door in the open position, bracket locking device 14, 72, 82 greatly increases the difficulty in removing the lock box mounting bracket without authorization. This design also permits the lock box mounting bracket to be removed by the client or homeowner without ever compromising the shackle-code or requiring the assistance of an agent. Accordingly, it would permit a homeowner to remove the lock box mounting bracket completely at night to absolutely ensure that no access could be gained via the use of the key stored in the lock box. Moreover, this feature would address the concerns of homeowners who often have erratic schedules or request more control over real estate showing availability. Lock box protection device 16 effectively protects the lock box, including its shackle, from hacksaws, bolt cutters, chisels, forcible impact, prying, etc., thereby adding another degree of protection while extending the life of the lock box shackle components. Also, the lock box mounting bracket of the present invention is formed of a one-piece construction wherein the lock box bracket body 12, lock box protection feature 16 and lock box engaging element 28 are integrally formed as a unitary assembly increasing the ease of use. In addition, the present design may be securely mounted to all standard entrance doors, residential and commercial, and fits both left and right opening doors without further modifications or adjustments.

What is claimed is:

1. A lock box mounting bracket for mounting on a hinge-edge of a door mounted on a hinge and movable between open and closed positions, the door having an interior side facing an interior space and an exterior side facing an exterior space when the door is in the closed position, the lock box mounting bracket comprising:

a bracket body shaped for mounting on the hinge-edge of the door, said bracket body including an exterior portion for supporting a lock box, said exterior portion positioned in the exterior space when the lock box mounting bracket is mounted on the door; and a bracket locking means formed on said bracket body and positioned in the interior space when said bracket body is mounted on the door for permitting secure locking of said bracket body to the door hinge and preventing unauthorized removal of the lock box mounting bracket when the door is in both the open and closed positions.

2. The bracket of claim 1, wherein said bracket body further includes an interior portion positioned in the interior space when the lock box mounting bracket is mounted on the door, said interior portion including a lower leg extending into the interior space on a lower side of the hinge and an upper leg extending into the interior space on an upper side of the hinge, said bracket locking means formed on said interior portion of said bracket body.

3. The bracket of claim 2, wherein said bracket locking means includes a first connector portion formed on said lower leg, a second connector portion formed on said upper leg and a connector device extending at least substantially between said first and the second connector portions.

4. The bracket of claim 3, wherein said first and said second connector portions each include an opening formed in said lower leg and said upper leg, respectively, for receiving said connector device.

5. The bracket of claim 2, wherein said bracket locking means includes at least one locking arm pivotally mounted on at least one of said upper and said lower legs.

6. The bracket of claim 5, wherein said bracket locking means further includes a connector portion formed on one of said lower and said upper legs for engagement by said locking arm.

7. The bracket of claim 5, wherein said at least one locking arm includes a lower locking arm pivotally connected to said lower leg and an upper locking arm pivotally connected to said upper leg.

8. The bracket of claim 5, wherein said at least one locking arm is movable between retracted and extended positions, further including a securing mechanism positioned on said bracket body for securing said at least one locking arm in said retracted position.

9. The bracket of claim 1, further including a lock box engaging element mounted on said exterior portion for secure engagement by a lock box and a lock box protection means connected to said bracket body for preventing damage to the lock box.

10. The bracket of claim 9, wherein said bracket body includes an edge portion positioned along the hinge-edge of the door and said exterior portion includes a back plate extending along the exterior side of the door, said lock box protection means including a side wall positioned a spaced distance along said back plate from said edge portion and extending outwardly from said back plate a distance at least equal to a side width extent of the lock box.

11. The bracket of claim 10, wherein the lock box includes a shackle, said lock box protection means further including a shield mounted on one of said lock box engaging element and said bracket body, said lock box engaging element positioned between said shield and said back plate, said shield positioned immediately adjacent said lock box engaging element and sized to shield a substantial portion of the lock box shackle when mounted on said lock box engaging element.

12. The bracket of claim 11, wherein said shield is connected to both said side wall and said lock box engaging element.

13. The bracket of claim 11, wherein said lock box protection means further includes at least one transverse projection extending from one of said side wall and said bracket body, and positioned a spaced distance from said shield.

14. The bracket of claim 13, wherein said at least one transverse projection includes two transverse projections connected to and extending from said side wall.

15. The bracket of claim 9, wherein said bracket body further includes an interior portion positioned in the interior space when the lock box mounting bracket is mounted on the door, said bracket body including an edge portion positioned along the hinge-edge of the door and said exterior portion including a back plate extending along the exterior side of the door, wherein said interior portion, said back plate, said edge portion, said lock box engaging element and said lock box protection means are integrally connected to form a unitary assembly.

16. The bracket of claim 1, wherein said lock box is fixedly attached to said exterior portion.

17. The bracket of claim 16, wherein said lock box includes a compartment for containing a key and an electrically actuated access control system for selectively permitting access to said compartment.

18. The bracket of claim 17, wherein said electrically actuated access control system includes a reader device connected to said lock box and a power source formed separately from said reader device and removably connectable to said lock box.

19. The bracket of claim 2, wherein said bracket body includes an edge portion positioned along the hinge-edge of the door, said edge portion including an upper edge section connected to said upper leg and a lower edge section connected to said lower leg, said upper and said lower sections positioned a spaced distance apart to accommodate the door hinge.

20. A lock box mounting bracket for mounting on a hinge-edge of a door mounted on a hinge and movable between open and closed positions, the door having an interior side facing an interior space and an exterior side facing an exterior space when the door is in the closed position, the lock box mounting bracket comprising:

a unitary bracket body including an exterior portion positioned in the exterior space when the lock box mounting bracket is mounted on the door for supporting a lock box, an interior portion positioned in the interior space when the lock box mounting bracket is mounted on the door and an edge portion connecting said exterior portion to said interior portion and positioned along the hinge-edge of the door when the mounting bracket is mounted on the door, said interior portion including a lower section extending into the interior space on a lower side of the hinge and an upper section extending into the interior space on an upper side of the hinge, said exterior portion, said interior portion and said edge portion integrally connected to form the unitary bracket body; and a bracket locking device formed on said interior portion and positioned in the interior space when said bracket body is mounted on the door to permit said bracket body to be securely connected to the door hinge to prevent unauthorized removal of the lock box mounting bracket when the door is in both the open and closed positions.

21. The bracket of claim 20, wherein said bracket locking device includes a first connector portion formed on said lower section, a second connector portion formed on said upper section and a connector device extending substantially between said first and the second connector portions.

22. The bracket of claim 21, wherein said first and said second connector portions each include an opening formed in said lower section and said upper section, respectively, for receiving said connector device.

23. The bracket of claim 20, wherein said bracket locking device includes at least one locking arm pivotally mounted on at least one of said upper and said lower sections and a connector portion formed on one of said lower and said upper sections for engagement by said at least one locking arm.

24. The bracket of claim 23, wherein said at least one locking arm is movable between retracted and extended positions, further including a securing mechanism positioned on said bracket body for securing said at least one locking arm in said retracted position.

25. The bracket of claim 20, further including a lock box engaging element mounted on said exterior portion for secure engagement by a lock box and a lock box protection device connected to said bracket body.

26. The bracket of claim 25, wherein said exterior portion includes a back plate extending along the exterior side of the door, said lock box protection device including a side wall positioned a spaced distance along said back plate from said edge portion and extending outwardly away from said back plate a distance equal to at least a side width extent of the lock box.

27. The bracket of claim 26, wherein the lock box includes a shackle, said lock box protection device further includes a shield mounted on one of said lock box engaging element and said bracket body, said lock box engaging element positioned between said shield and said back plate, said shield positioned immediately adjacent said lock box engaging element and sized to shield a substantial portion of the lock box shackle when mounted on said lock box engaging element.

28. The bracket of claim 27, wherein said lock box protection device further includes at least one transverse projection positioned a spaced distance from said shield, said at least one transverse projection connected to and extending from said side wall.

29. The bracket of claim 20, wherein said unitary bracket body further includes said lock box, said lock box being integrally attached to said exterior portion.

30. The bracket of claim 29, wherein said lock box includes a compartment for containing a key and an electrically actuated access control system for selectively permitting access to said compartment.

31. The bracket of claim 20,wherein said edge portion includes an upper edge section connected to said upper section of said interior portion and a lower edge section connected to said lower section of said interior portion, said upper and said lower sections positioned a spaced distance apart to accommodate the door hinge.

32. A lock box mounting bracket for mounting on a hinge-edge of a door mounted on a hinge and movable between open and closed positions, the door having an interior side facing an interior space and an exterior side facing an exterior space when the door is in the closed position, the lock box mounting bracket comprising:

a bracket body including an exterior portion positioned in the exterior space when the lock box mounting bracket is mounted on the door for supporting a lock box, an interior portion positioned in the interior space when the lock box mounting bracket is mounted on the door and an edge portion connecting said exterior portion to said interior portion and positioned along the hinge-edge of the door when the mounting bracket is mounted on the door;

a lock box protection means positioned on said bracket body for preventing damage to the lock box;

a bracket locking device formed on said interior portion and positioned in the interior space when said bracket body is mounted on the door to permit said bracket body to be securely connected to the door hinge so as to prevent unauthorized removal of the lock box mounting bracket when the door is in both the open and closed positions.

33. The bracket of claim 32, further including a lock box engaging element mounted on said exterior portion for secure engagement by the lock box, said exterior portion including a back plate extending along the exterior side of the door, said lock box protection means including a side wall positioned a spaced distance along said back plate from said edge portion and extending outwardly away from said back plate a distance equal to at least a side width extent of the lock box.

34. The bracket of claim 33, wherein the lock box includes a shackle, said lock box protection means further includes a shield mounted on one of said lock box engaging element and said bracket body, said lock box engaging element positioned between said shield and said back plate, said shield positioned immediately adjacent said lock box engaging element and sized to shield a substantial portion of the lock box shackle when mounted on said lock box engaging element.

35. The bracket of claim 34, wherein said shield is connected to both said side wall and said lock box engaging element.

36. The bracket of claim 34, wherein said lock box protection means further includes at least one transverse projection positioned a spaced distance from said shield.

37. The bracket of claim 36, wherein said at least one transverse projection includes two transverse projections connected to and extending from said side wall.

38. The bracket of claim 32, wherein said interior portion, said exterior portion, said edge portion and said lock box protection means are integrally connected to form a unitary assembly.

39. The bracket of claim 32, wherein said edge portion includes an upper edge section and a lower edge section positioned a spaced distance apart to accommodate the door hinge.

* * * * *